US005083715A

United States Patent [19]

Wirtz et al.

[11] Patent Number: 5,083,715

[45] Date of Patent: Jan. 28, 1992

[54] APPARATUS FOR LOOSENING AN END OF TEXTILE MATERIAL

[75] Inventors: Ulrich Wirtz; Helmuth Hensen, both of Monchen-Gladbach; Hans-Gunter Wedershoven, Nettetal; Wolfgang Irmen, Monchen-Gladbach, all of Fed. Rep. of Germany

[73] Assignee: W. Schlafhorst AG & Co., Monchen-Gladbach, Fed. Rep. of Germany

[21] Appl. No.: 562,744

[22] Filed: Aug. 6, 1990

[30] Foreign Application Priority Data

Aug. 5, 1989 [DE] Fed. Rep. of Germany ..... 3925988

[51] Int. Cl.[5] ..... B65H 54/00; B65H 67/08

[52] U.S. Cl. ..... 242/18 R; 242/35.6 E

[58] Field of Search ..... 242/35.6 E, 35.6 R, 242/35.5 R, 35.5 A, 18 R

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 4,896,841 | 1/1990 | Topuett | 242/35.6 E |
| 4,921,179 | 5/1990 | Surkamp et al. | 242/18 R |

FOREIGN PATENT DOCUMENTS

| | | |
|---|---|---|
| DE2531044 | 4/1986 | Fed. Rep. of Germany . |
| 430534 | 8/1967 | Switzerland . |

*Primary Examiner*—Stanley N. Gilreath
*Attorney, Agent, or Firm*—Shefte, Pinckney & Sawyer

[57] ABSTRACT

An apparatus for handling the end of a strand of textile material built into a package is provided. The strand end handling apparatus includes a tangentially engaging member for tangentially engaging the outer surface of a yarn package to dislodge a strand end therefrom and a sensing member for sensing a dislodged strand end. Additionally, the strand end handling apparatus includes a control member, for controlling subsequent handling of the yarn package following the sensing of a dislodged strand end.

15 Claims, 4 Drawing Sheets

APPARATUS FOR LOOSENING AN END OF TEXTILE MATERIAL

BACKGROUND OF THE INVENTION

The present invention relates to an apparatus for loosening an end of a strand of textile material has been wound on a tube in the form of a package so that the strand end can be readily engaged in a subsequent operation.

One common practice for facilitating the engagement of an end of a strand of yarn at a subsequent yarn handling location is to form a so-called reserve winding on a package at the completion of the building of the package. For example, it is known to provide yarn packages built at the spinning stations of a ring spinning machine with a reserve winding by relatively rapid downward movement of the ring rail of the ring spinning machine toward the end of the yarn package building operation. To facilitate subsequent engagement of the so-called reserve winding, one common practice has been to wind the end portion of the reserve winding on the exposed bottom portion of the tube on which the yarn package is built, thereby forming a so-called reserve winding end piece.

However, in certain types of yarn package building operations such as, for example, those in which the doffing of completed yarn packages is a substantially fully automatic process, the building of a reserve winding end piece on an exposed portion of the tube is often omitted. It is therefore critical that the reserve winding which is formed—that is, the end of the strand of textile material which is exposed on the outer surface of the yarn package—can be readily engaged without damaging the other windings of the yarn package. In U. S. Pat. No. 4,681,271, a device is disclosed for applying suction to a yarn package to thereby loosen and engage the strand of textile material. However, such suction-type yarn end engaging devices have relatively significant energy requirements as well as relatively significant capital costs. In U. S. Pat. No. 2,675,971, a yarn end preparation device is disclosed which has a hook-shaped wire positionable relative to the outer surface of a yarn package to engage the end of a strand of textile material thereon, which tends to pull the yarn end and thereby tighten the windings of the yarn ends on the package.

Therefore, there is a need for improvements in devices for engaging a reserve winding disposed on the outer surface of a yarn package.

SUMMARY OF THE INVENTION

The present invention provides a strand end engaging apparatus which advantageously reduces energy costs and minimizes damage to a yarn package through the use of means for sensing a dislodged strand end and control means for controlling the engagement of the apparatus with the yarn package in response to sensing of the dislodged strand end.

Briefly summarized, the present invention provides, in one aspect thereof, a strand end handling apparatus in an assembly for loosening an end of a strand of textile material built on a tube to form a package, the assembly being of the type having a device for rotating a package about its axis. The strand end handling engaging includes means for substantially tangentially engaging the outer surface of the package during axial rotation thereof to effect dislodgement of a strand end therefrom and means for sensing the dislodgement of a strand end by the tangential engaging means. Also, the strand end handling apparatus includes control means, operatively connected to the sensing means, for controlling the operation of the assembly in response to the sensing.

The strand end engaging apparatus preferably includes the feature of search duration means for controlling the tangential engaging means. Also, the strand end handling apparatus includes control means, operatively connected to the sensing means, for controlling the operation of the assembly in response to the sensing.

The strand end engaging apparatus preferably includes the feature of search duration means for controlling the tangential engaging means to move from its engage position to its disengage position in correspondence with the lapse of a predetermined period of time if the sensing means had not previously sensed a dislodged strand end prior to the lapse of the predetermined period of time.

The tangential engaging means includes, in one form thereof, a blade member having a free end disposable for strand engaging contact with the package and having a front surface facing the package and a rear surface facing away from the package. The surfaces extend from the free end in the direction of unwinding rotation of the package, and the rear surface extends from the free end outwardly from the package for support of a dislodged strand end at a spacing from the package for sensing by the sensing means. The strand end engaging apparatus also preferably includes a guide member extending adjacent the blade member for engagement and guiding of a dislodged strand end intermediate the rear surface and the package at a spacing from the free end.

In one embodiment of the strand end engaging apparatus, the guide member has an opening extending adjacent the package for extension of the rear surface of the blade member therethrough, the guide member cooperating with the blade member to guide the dislodged strand end through the opening for sensing by the sensing means. The opening is preferably defined by opposed surfaces between which the rear surface of the blade member is disposed for guiding of the strand end to extend from one of the opposed surfaces to and across the rear surface and from the rear surface to the other of the opposed surfaces.

In the one aspect of the strand end engaging apparatus of the present invention, the tangential engaging means is movable between a disengage position out of engagement with the package to an engage position in which the tangential engaging means tangentially engages the outer surface of the package, and the control means is operable to move the tangential engaging device from its engage position to its disengage position in response to the sensing of a dislodged strand end by the sensing means.

According to a further feature of the one aspect of the strand end engaging apparatus of the present invention, means for transporting packages to and from the strand end handling apparatus for the loosening of strand ends on the packages are also provided, and the control means controls the transporting means to transport a package from, and a fresh package to, the strand end handling apparatus in response to sensing by the sensing means of a dislodged strand end.

According to additional features of the one aspect of the strand end engaging apparatus, the control means includes means for de-activating the package rotating device in response to sensing of a dislodged strand end by the sensing means to thereby effect cessation of the rotation of the package. Also, the control means preferably includes means for de-activating the package rotating device in response to movement of the tangential engaging device from its engaged position to its disengaged position.

According to another feature of the strand end engaging apparatus, the blade member is mounted preferably on the guide member and the guide member is pivotally supported for movement of the guide member and the blade member to and away from a package. Also, the sensing means preferably includes a light emitting component and a light detecting component, the light emitting component emitting a light beam and the light detecting component detecting an interruption of the light beam by the passage of a dislodged strand end through the light beam.

According to yet another feature of the one aspect of the strand and engaging apparatus of the present invention, end winding suction means are provided for applying suction to the bottom portion of the tube of the package to effect removal of a portion of the strand end remaining thereon following dislodgement of the strand end from the package.

According to another aspect of the present invention, a strand end handling apparatus is provided in an assembly for loosening an end of a strand of textile material built on a tube to form a package, the assembly being of the type having a device for rotating a package about its axis with a strand end wound with windings progressing away from one end of the tube to the free end of the strand end. The strand end handling apparatus includes first means for tangentially engaging the outer surface of the package at a first engaging location during axial rotation of the package to effect dislodgement of a strand end therefrom and second means for tangentially engaging the outer surface of the package at a second engaging location axially intermediate the first engaging location and the tube end during axial rotation of the package to effect dislodgement of a strand end therefrom. Also, the strand end handling apparatus includes means for sensing the dislodgement of a strand end by at least one of the first and second tangential engaging means and control means, operatively connected to the sensing means, for controlling the operation of the assembly in response to sensing by the sensing means.

Each of the first and second tangential engaging means is preferably movable between a disengage position out of engagement with the package and an engage position in which the respective tangential engaging means tangentially engages the outer surface of the package, and the control means initially controls the second tangential engaging means to remain in its disengage position and the first tangential engaging means to move to its engage position and thereafter controls the second tangential engaging means to move to its engage position upon the sensing by the sensing means of a strand end dislodged by the first tangential engaging means.

DETAILED DESCRIPTION OF THE PREFERRED EMBODIMENTS

Figure 1:
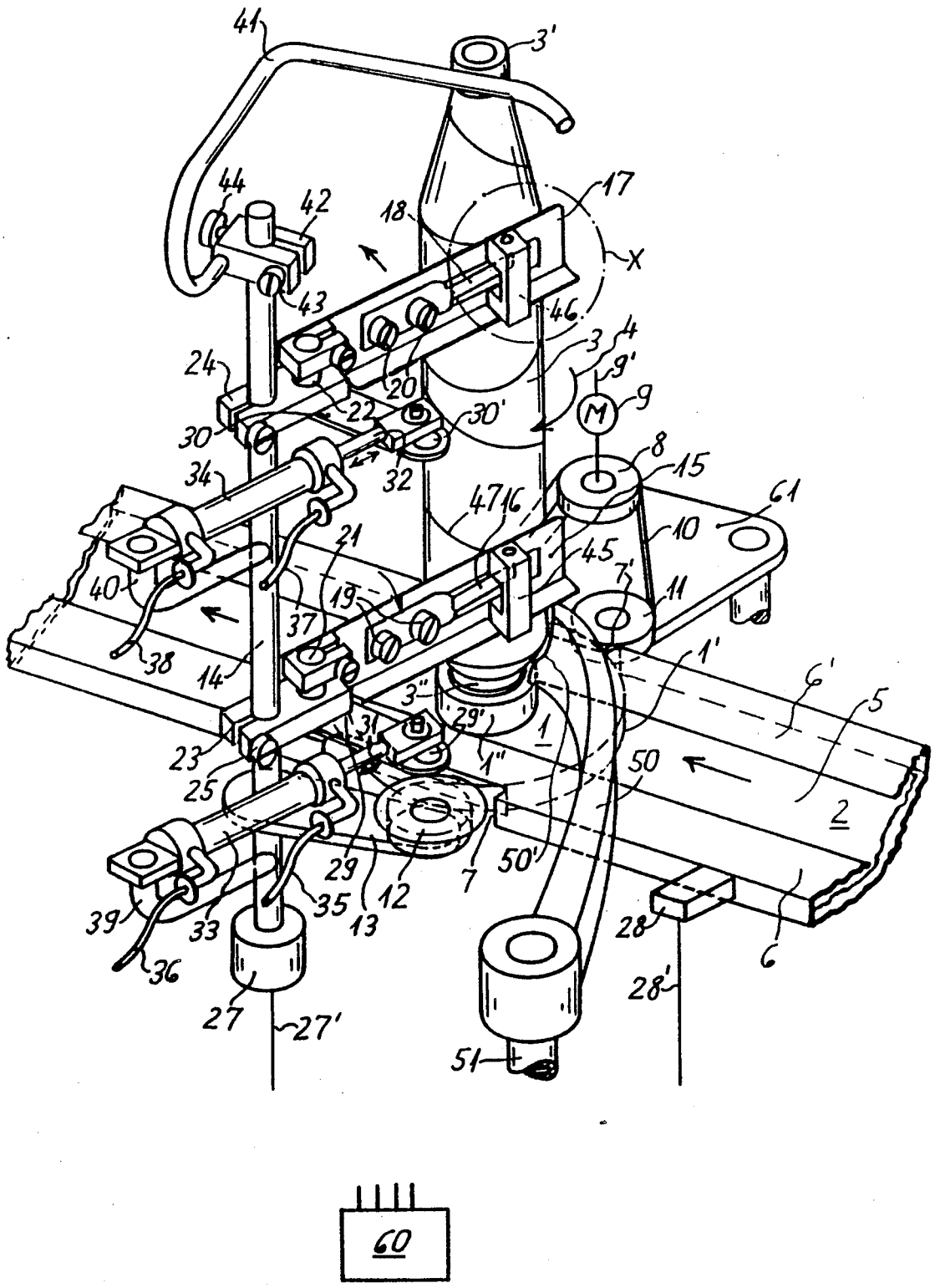
FIG. 1 is a perspective view of a yarn package transport assembly showing one embodiment of the strand end handling apparatus of the present invention installed relative to the yarn transport assembly for handling yarn packages transported therealong.

In FIG. 1, one embodiment of the strand end handling apparatus of the present invention is illustrated for handling the strand ends of a plurality of packages formed of textile material built on tubes such as, for example, a yarn package 3. The yarn packages 3 are each individually supported on a package support members 1 of the type having an upright post for receiving the tube of a yarn package 3 inserted thereon, an annular neck portion 1" formed below the upright post for supporting the tube of the yarn package 3 thereon and an annular base portion 1'. The package support member 1, with the yarn packages 3 supported in upright dispositions thereon, are transported by a conventional yarn package transport assembly 2 to a location for handling of the yarn packages 3, such as, for example, the winding stations of a winding machine for winding the yarn built on the yarn packages 3. The strand end handling apparatus of the present invention is disposed relative to the yarn package transport assembly 2 for handling the strand ends of the yarn packages 3 in preparation of the yarn packages for subsequent handling at the winding stations.

The yarn package transport assembly 2 includes an endless member or belt 5 supported by a pair of guide channels 6, 6'. Each guide channel 6, 6' includes a lower surface for supporting the belt 5 during its travel along its upper run in the direction shown by the arrows in FIG. 1 and an upper guide surface. The upper parallel, spaced relation to one another for receiving the neck portions 1'" of the package support members 1 therebetween for guiding of the package support members.

The strand end handling apparatus includes a device for effecting rotation of a yarn package 3 about the axis of its tube during handling by the strand end handling apparatus. The package rotation device includes a pair of rotation rollers 1; (only one of which is visible in FIG. 1) at one side of the yarn transport assembly and a press roller !2 at the other side of the yarn transport assembly and having a radially enlarged top flange portion for overlapping the base portion 1' of a package support member. The press roller 12 is freely rotatably mounted on a pivot arm 13 that is fixed on a common pivot shaft 14 that is mounted to a conventional shaft rotating component such as, for example, a rotary solenoid 27, for rotation of the common pivot shaft 14 about its axis.

The rotary solenoid 27 is connected via a connector 27' to a control unit 60 which controls the rotary solenoid 27 to effect rotation of the common pivot shaft 14 about its axis. By controlling the rotation of the common pivot shaft 14 about its axis, the control unit 60 controls the movement of the press roller 12 between a disengage position out of interference with a respective package support member at the strand end handling location and an engage position in which the press roller 12 is pivoted through an opening 7 in the guide channel 6 for direct engagement with the annular base portion 1' of the respective package support member 1. In the engage position of the press roller 12, the circumferential surface of the press roller 12 is in rolling engagement with the circumferential surface of the annular base portion 1' and the radially enlarged annular portion of the press roller 12 is in overlying relation with a portion of the top surface of the annular base portion 1' of the respective package support member 1.

The pair of rotation rollers !1 are freely rotatably mounted on a pivot plate 61 and are driven by a drive roller 8 freely rotatably mounted on the pivot plate 61 remote from the rotation rollers I! and drivingly interconnected to a drive motor for driving rotation thereby. The drive motor 9 is operatively connected by a connector 9' to the control unit 60. A belt 10 is trained around the pair of rotation rollers 11 and the drive roller for selective reversible driving of the rotation rollers 11 by the drive motor 9.

The pivot plate 61 is mounted on a vertical pivot shaft that is operatively connected to a conventional pivot drive mechanism (not shown) such as, for example, a rotary solenoid, which is operatively connected to the control unit 60. An opening 7' in the guide channel 6' permits movement of the rotation rollers 11 interiorly of the guide channel 6' for direct engagement of the drive belt 10 between the rollers 11 with the circumferential surface of the annular base portion 1' of a respective package support member 1 at the strand end handling location. The control unit 60 controls the pivoting movement of the pivot plate 61 to effect movement of the pivot plate between a disengage position in which the drive belt 10 is out of interference with the respective package support member 1 at the strand end handling location and an engage position in which the drive belt 10 is in engagement with the package support member 1.

The control unit 60 synchronously controls the movements of the press roller 12 and the pivot plate 61 between their respective disengage and engage positions to effect stopping and rotation of a package support member 1 advanced to the strand end handling location by the yarn package transport assembly 2. As a package support member 1 is advanced into the strand end handling location, the control unit 60 controls the pivoting of the pivot arm 13 and the pivot plate 61 to substantially simultaneously move the press roller 12 and the drive belt 10 into their respective, circumferentially-spaced engagement locations on the annular base portion 1' of the package support member 1. The movement of the drive belt 10 is transmitted via the frictional engagement of the drive belt with the circumferential surface of the annular base portion 1' of the package support member to effect corresponding rotation of the package support member 1. Additionally, the press roller 12 and the rotation rollers 11 cooperate together to retain the respective package support member 1 at the strand end handling location.

As seen in FIG. 1, a conventional arrival sensor 28 is mounted to the guide channel 6 for sensing the presence of a package support member 1 at an arrival location upstream of the strand end handling location relative to the direction of travel of the belt 5. The arrival sensor 28 is operatively connected via a connector 28' to a control unit 60.

Figure 2:
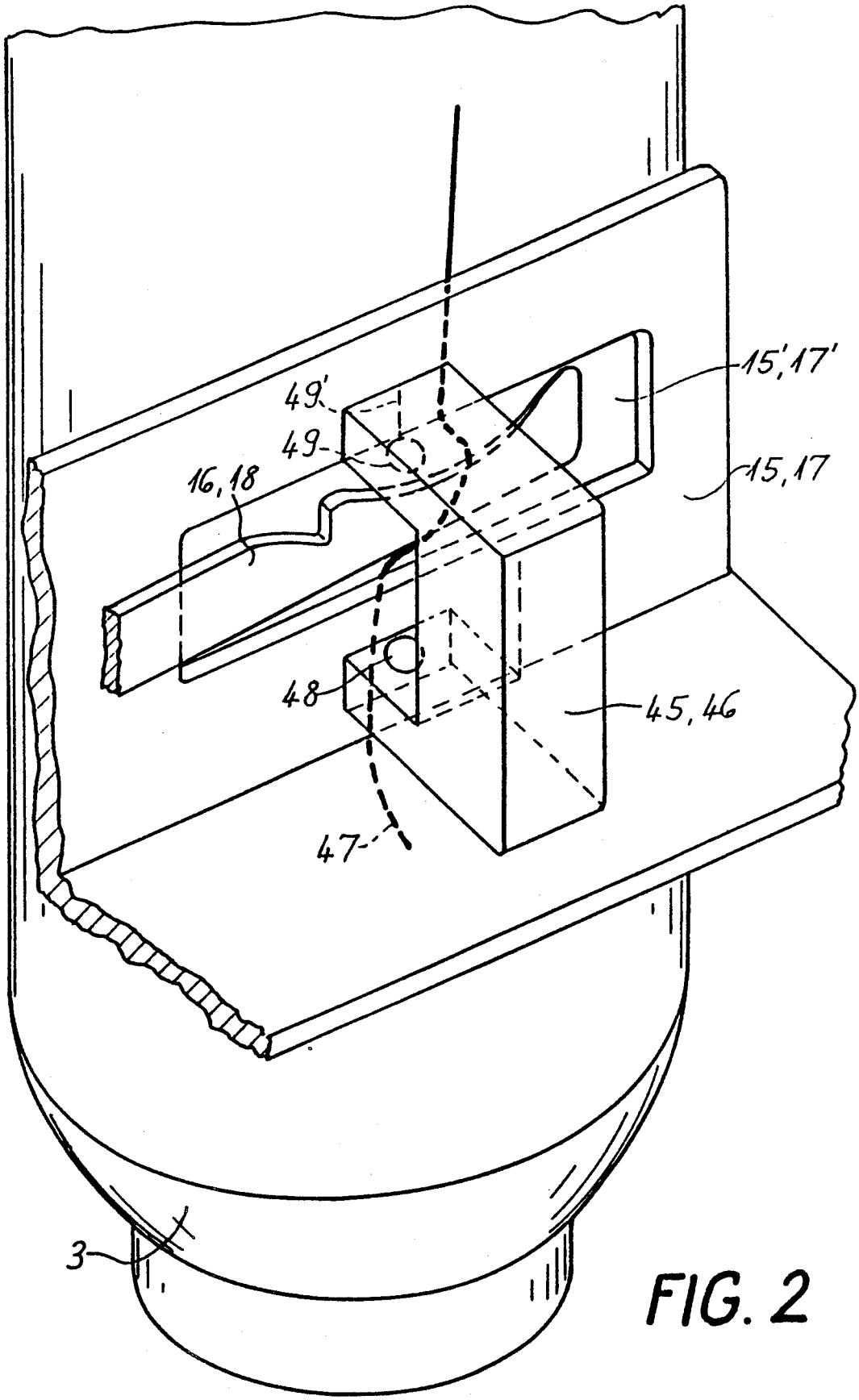
FIG. 2 is an enlarged perspective view of the detail of one form of the tangential engaging means and the sensing means of the strand end handling apparatus of the present invention as seen in the lower portion of FIG. 1 that corresponds to the upper portion shown in the circle X in FIG. 1.

The strand end handling apparatus also includes means for tangentially engaging the outer surface of a yarn package 3 supported at the strand end handling location. The tangentially engaging means is operable to engage the outer surface of a yarn package 3 at a substantially tangent orientation thereto during axial rotation of the package to effect dislodgement of a strand end therefrom. In the embodiment of the strand end handling apparatus illustrated in FIG. 1, first and second tangentially engaging means for engaging the outer surface of a yarn package 3 at axially spaced locations thereon are illustrated and the structure and operation thereof are commonly discussed herein, it being understood that the present invention contemplates, in one configuration, only a single tangentially engaging means, while, in another configuration, a pair of tangentially engaging means are provided for operation in a predetermined, coordinated manner with one another. As seen in FIGS. 1 and 2 the first and second tangentially engaging means each includes a frame member 15, 17 for supporting a blade member 16, 18. The frame member 15, 17 is fixedly mounted by a clamp at one end to a pivot shaft 21, 22 that is rotatably supported in a bracket 23,24 that is clamped by bolts 25 to the aforementioned common pivot shaft 14.

The blade member 16, 18 is of elongate form and has a free end and another end which is fixedly mounted to the frame member 15, 17 by a pair of fastening bolts 19, 20 threadably received in corresponding threaded bores in the frame member 15, 17. The bolts 19, 20 which secure the blade member 16, 18 to the frame member 15, 17, respectively, can be received in a slot formed on the frame member for permitting adjustment of the blade member along its longitudinal extent in correspondence with the diameter of the yarn packages to be handled.

Each frame member 15, 17 is in the form of a guide member for guiding a dislodged strand end in cooperation with the blade member 16,18. Opposed surfaces of the guide member define a generally planar opening 15', 17'. The free end of the blade member 16, 18 extends through the opening 15', 17', as best seen in FIG. 2 in a disposition for strand engaging contact with each yarn package 3. Each blade member 16, 18 includes a generally planar front surface and a generally planar rear surface facing away from the yarn package 3. The front and rear surfaces of the blade member 16,18 extend from the blade member free end in the direction of unwinding rotation of the yarn package 3. Additionally, the rear surface extends from the blade member free end outwardly from the yarn package 3 for support of a dislodged strand end at a spacing from the package for sensing by means for sensing the dislodgement of a strand end by the tangential engaging means. The rear surface of the blade member 16,8 extends between the opposed surfaces of the guide member which define the opening 15',17' for guiding of the strand end to extend from one of the opposed guide member surfaces to and across the rear surface of the blade member and from the rear surface to the other of the opposed guide member surfaces.

The sensing means is in the form of a strand sensing device 45,46 mounted to the frame member 15,17 adjacent the opening 15',17. The strand sensing device 45,46 includes a light emitting component 48 for emitting a beam of light in a generally vertical direction and a light sensing component 49 for sensing interruptions in the beam of light emitted by the light emitting component 48. The light sensing component 49 is operatively connected by a connector 49' to a control unit 60 for providing signals thereto relating to the interruption of the light beam.

The strand sensing device 45,46 has an C-shaped mounting portion for mounting the light emitting component 48 and the light sensing component 49 in their operating positions. Each leg of the C-shaped mounting portion is secured to the frame member 15,17 on a respective opposite side of the opening 15',17' and the light emitting component 48 and the light sensing component 49 are each mounted on a respective leg of the mounting portion.

Each first and second tangentially engaging means includes an actuating component for selectively moving the blade member 16, 17 between a disengage position out of interference with the outer surface with the yarn package 3 at the strand end handling location and an engage position in which the blade member 16, 18 is in engagement with the outer surface of the yarn package. The actuating component of the tangentially engaging means includes a pivot arm 29, 30 fixedly mounted at one end to the pivot shaft 21, 22. The other end of the pivot arm 29, 30 is pivotally connected via a conventional pivot connection member 29', 30' to the free end of a piston 31, 32 of a conventional pneumatic cylinder and piston assembly 33, 34 that is fixedly mounted via a rigid bracket 39, 40 to the common pivot shaft 14. An air inlet member 35, 37 and an outlet member 36, 38 are connected to a conventional source of pneumatic fluid (not shown) for effecting pneumatic actuation of the pneumatic cylinder and piston assemblies 33, 34. The conventional compressed air source is operatively connected to the control unit 60 for controlled actuation of the pneumatic cylinder and piston assemblies 33, 34 to effect pivoting movement, via the pivot arms 29, 30 of the frame members 15, 17.

The strand end handling apparatus additionally includes a supplemental package supporting component having a rigid, contoured guide rod 41. One end of the guide rod 41 is received in a cylindrical bore of a clamp bracket 42 and a securement bolt 44 is threadably received in a threaded bore of the clamp bracket 42 to compressively secure the inserted end of the guide rod 41 in the clamp bracket 42. The clamp bracket 42 includes a conventional clamping structure having a split bore for receiving the common pivot shaft 14 therein to effect compressive securement of the clamp bracket 42 to the common pivot shaft 14 at a location thereon axially above the first and second tangentially engaging means. A tightening bolt 43 is threadably received in a threaded bore in the clamp bracket 42 for removably compressively securing the clamp bracket 42 to the common pivot shaft 14. The guide rod 41 is configured to engage the exposed tube end 3' of the yarn package 3 to apply a tilting force to the yarn package 3 in a direction generally opposed to the engagement of the top flange of the press roller 12 with the package support member base 1', thereby enhancing the frictional engagement between the inner surface of the bottom of the tube of the yarn package and the upright peg of the package support member 1 to facilitate transmission of the rotation of the package support member to the yarn package 3. The axial position of the guide rod 41 and its orientation relative to the exposed tube end 3' of a yarn package 3 can be selectively adjusted for best results.

The operation of the embodiment of the strand end handling apparatus shown in FIG. 1 is as follows. The package support members 1, with the yarn packages 3 supported in upright dispositions thereon, are advanced by the action of the belt 5 in the direction toward the strand end handling location. During transport of the package support members 1 by the belt 5, the upper guide surfaces of the guide channel 6, 6' overlie portions of the top surface of the annular base portions 1' of the package support members while the neck portions 1'' of the package support members are centrally guided between the inner edges of the guide channels 6, 6'. The arrival sensor 28 senses the presence of a package support member 1 traveling therepast and signals this information via the connector 28' to the control unit 60. In response to the signal from the arrival sensor 28, the control unit 60 actuates pivoting of the pivot arm 13 and the pivot plate 61 of the package rotation component to move the press roller 12 and the drive belt 10 from their disengage positions in which they are normally maintained to their respective engage positions. The movement of the press roller 12 and the drive belt 10 to their respective engage positions is coordinated with the further advancement of the sensed package support member into the strand end handling location so that the press roller 12 and the drive belt 10 move into engagement with the annular base portion 1, of the respective package support member 1 as the package support member arrives at the strand end handling location.

The first and second tangentially engaging means are normally maintained in their disengage positions in which the pistons 31, 32 are retained in their retracted positions through appropriate flow of pneumatic fluid to the cylinders. In their disengage position, the tangentially engaging means are positioned sufficiently laterally outwardly with respect to the direction of advancement of the yarn packages 3 to permit free passage of the upright yarn package 3 supported on the respective package support member 1 advanced into the strand end handling location.

In correspondence with the movement of the press roller 12 and the drive belt 10 into engagement with the respective package support member 1 at the strand end handling location, the control unit 60 controls the conventional pneumatic fluid source to supply pneumatic fluid to the pneumatic cylinder and piston assembly 33, 34 to effect extension of the piston 31, 32. The extension of the piston 31, 32 effects pivoting of the frame members 15, 17 about the axis of the pivot shaft 21, 22, in a counter-clockwise direction as seen in FIG. 1 to move the first and second tangentially engaging means into their engage positions.

As the first and second tangentially engaging means moves into their engage positions, the front surface of the blade members 16, 18 tangentially engage the outer surface of the yarn package 3, which is rotating about its axis in the direction indicated by the arrow 4 in FIG. 1 in correspondence with the rotation of the package support member 1 under the driving action of the drive belt 10. The blade members 16, 8 engage an end of a strand of the textile material wound on the yarn package 3 such as, for example, a strand end 47 as seen in FIGS. 1 and 2, and dislodge the strand end from the outer surface of the yarn package. The continuing rotation movement of the yarn package 3 subsequent to the dislodgement of the strand end 47 by the blade members 16, 18 effects movement of the dislodged strand end 47 along the rear surface of the blade members in a direction away from the free ends of the blade members and thereafter through the light beam emitted by the light emitting components 48. As the dislodged strand end 47 is moved through the light beams, the light sensing components 49 sense the interruption of the light beams by the dislodged strand end 47 and signal the control unit 60 via the connector 49' concerning the interruption. The guide members forming the opening of the frame members guide the dislodged strand end 47 intermediate the rear surface of the blade members 16,18 and the yarn package 3 at a spacing from the blade member free ends.

The control unit 60 controls the strand end handling operation in response to the sensing signal received from the light sensing components 49. For example, the control unit 60 can be configured to actuate the conventional pneumatic fluid source to supply pneumatic fluid to the pneumatic cylinder and piston assemblies 33, 34 to thereby effect movement of the first and second tangential engaging means to their respective disengage positions. The supply of pneumatic fluid to the pneumatic cylinder and piston assemblies 33, 34 effects retraction of the pistons 31, 32 and corresponding pivoting of the frame members 15, 17 in a clockwise direction as seen in FIG. 1 which thereby effects movement of the blade members 16, 18 out of tangential engagement with the outer surface of the yarn package 3.

The movement of the blade members 16, 18 immediately upon, or shortly after, the sensing of the dislodged strand end 47 beneficially minimizes the risk that the dislodged strand end 47 may be pressed by the blade members 16, 18 or the frame members 15, 17 into the outer surface of the yarn package 3. Additionally, the relatively rapid movement of the blade members 16, 18 out of engagement with the outer surface of the yarn package following the dislodging of a strand end therefrom beneficially minimizes the time during which the strand end is subjected to a force by the tangentially engaging means. The force applied to the strand end by the tangentially engaging means detrimentally tightens the strand of textile material extending from the dislodged strand end which is still wound on the yarn package.

The control unit 60 can also be configured to control the operation of the yarn package transport assembly 2 in response to the sensing of the dislodged strand end 47 in lieu of, or in supplementation of, the control of the first and second tangentially engaging means in response to the sensing. Additionally, the control unit 60 Can be configured to de-activate the package rotation component in response to the sensing of a dislodged strand end by controlling the rotary solenoid 27 via the connector 27' and the conventional pivot drive mechanism to effect pivoting of the press roller 2 and the drive belt 10, respectively, to their respective disengage positions. If the belt 5 is continuously operating during this operation, the movement of the press roller 12 and the drive belt 0 out of interference with the respective package support member releases the package support member to be further advanced by the belt 5 beyond the strand end handling location.

The control unit 60 can alternatively be configured to control the operation of the drive motor 9 to cease the driving of the drive belt 10 in response to the sensing of a dislodged strand end. The controlling of the drive motor 9 can be coordinated in correspondence with the control of the first and second tangentially engaging means. For example, the drive motor 9 can be actuated to cease driving of the drive belt 10 subsequent to the controlling of the first and second tangentially engaging means by the control unit 60 to move out of interference with the yarn package 3.

The present invention also contemplates that the de-activation of the drive motor 9 can be accomplished by providing a conventional contact switch (not shown) operatively connected to the drive motor 9 and positioned for engagement by a respective one of the frame members 15, 17 as the respective tangential engaging means associated with the frame member moves into its disengage position. The contact switch would be operable to transmit a deactivation signal to the drive motor 9 upon engagement with the switch by the respective frame member 15, 17.

The present invention additionally contemplates that a conventional timer component can be operatively connected to the control unit 60 to provide a search duration means for cessation of the strand end handling activity with respect to each yarn package 3 after a predetermined maximum time. For example, the timer component could be configured to be activatable upon movement of the first and second tangential engaging means into engagement with the respective yarn package 3 and to thereafter provide a lapse signal to the control unit 60 after the lapse of a predetermined maximum period of time if a sensing signal had not previously been generated by the strand sensing device 45, 46. The cessation of a strand end loosening process after a maximum predetermined period of time beneficially reduces the risk of an accumulation of an unacceptable number of yarn packages awaiting the strand end handling process.

The control unit 60 can also be configured to effect cessation of the driving of the drive belt 10 and to effect movement of the press roller 12 and the drive belt 10 to their respective disengage positions in response to the lapse of the maximum predetermined period of time. Thus, if a strand end of the respective yarn package 3 had not been loosened by one or both of the first and second tangential engaging means prior to the lapse of the maximum predetermined period of time, the yarn package 3 would be released to be advanced further by the yarn package transport assembly 2. In this regard, the yarn package transport assembly 2 can be provided with a conventional package support member diverting means for diverting those yarn packages 3 which have not had a strand end successfully loosened by the strand end handling apparatus. The conventional package support member diverting means can divert such yarn packages 3 to a handling location having a conventional yarn end preparation device to subject such yarn packages 3 to further strand end handling operations. Alternatively, the other yarn end preparation device can be positioned adjacent the travel path of the belt 5 downstream of the strand end handling location.

In the preferred operation of the strand end handling apparatus shown in FIG. 1, the first and second tangentially engaging means are operated in a predetermined sequence under the control of the control unit 60 to insure trouble-free dislodgement of the strand end 47. As the windings of the strand end 47 progress away from the upper end of the yarn package 3 to the free end of the strand, the control unit 60 is accordingly configured to initially manipulate only the first tangentially engaging means, which is the lower of the two and the farthest from the free end 3' of the tube 3, to move from its respective disengage position to its engage position, while the second tangentially engaging means which engages the outer surface of the yarn package 3 at an engaging location axially intermediate the engaging location of the first tangentially engaging means and the upper end 3' of the yarn package 3, is maintained in its disengage position. Thus, the first blade member 16 is moved into engagement with the outer surface of the yarn package 3 and the subsequent dislodgement of the strand end 47 by the first blade member 16 is sensed by the strand sensing device 45, which provides a corresponding signal to the control unit 60. In correspondence with the receipt of the sensing signal from the strand sensing device 45, the control unit 60 controls the second tangentially engaging means to move from its disengage position to its engage position. The second blade member 18 then dislodges another portion of the strand end 47 and the strand sensing device 46 senses the dislodgement of the other portion of the strand end 47 and signals the control unit 60.

The sequential dislodgement of the strand end 47 first by the first tangentially engaging means and subsequently by the second tangentially engaging means minimizes the risk that a separated or torn portion of the strand end 47 will be present on the outer surface of the yarn package 3 following the strand end handling operation. Such an undesirable result can occur if the second tangentially engaging means initially dislodges the strand end since the movement of the second tangentially engaging means away from the yarn package after sensing of the dislodged strand end can result in tearing of the strand end. Accordingly, the portion of the dislodged strand end beyond the tearing location would remain wound on the outer surface of the yarn package 3 and lead to undesirable problems during subsequent handling of the yarn package.

In one modification of the embodiment of the strand end handling apparatus illustrated in FIG. 1, an end winding suction component 50 is provided for handling a portion of the strand end which may remain on the exposed bottom tube portion 3" following dislodgement of the strand end should the strand end 47 be in the form of a reserve winding which terminates in an end piece wound on the exposed bottom tube portion 3", in which case the tangentially engaging means will likely tear the strand, leaving the end winding on the bottom tube portion 3". If the tangentially engaging means are controlled to move to their disengage positions immediately upon, or shortly after, the sensing of a dislodged strand end, a tearing of the dislodged strand end may result.

The end winding suction component 50 includes a suction conduit 50' communicated via a tube 51 with a conventional suction source (not shown). The suction conduit 50' includes an opening at its free end for applying a suction relatively closely adjacent the exposed bottom tube portion 3" of the yarn package 3 to effect complete dislodgement of a remaining end winding. The tube 51 is pivotally mounted to the frame of the package transport assembly 2 for pivotal movement of the suction conduit 50' between a clearance position out of interference with the package support members 1 being transported by the yarn package transport assembly 2 and a suction applying position in which the free end of the suction conduit 50' is positioned relatively closely adjacent the exposed bottom tube portion 3" of the respective yarn package 3 at the strand end handling location. In the operation of the end winding suction component 50, it is preferable that the rotation of the package support member 1 be continued during the suction operation to facilitate removal of the end winding by the end winding suction component. The end winding can thus be removed from the yarn package and transported to a convenient location for disposal thereof.

Figure 3:
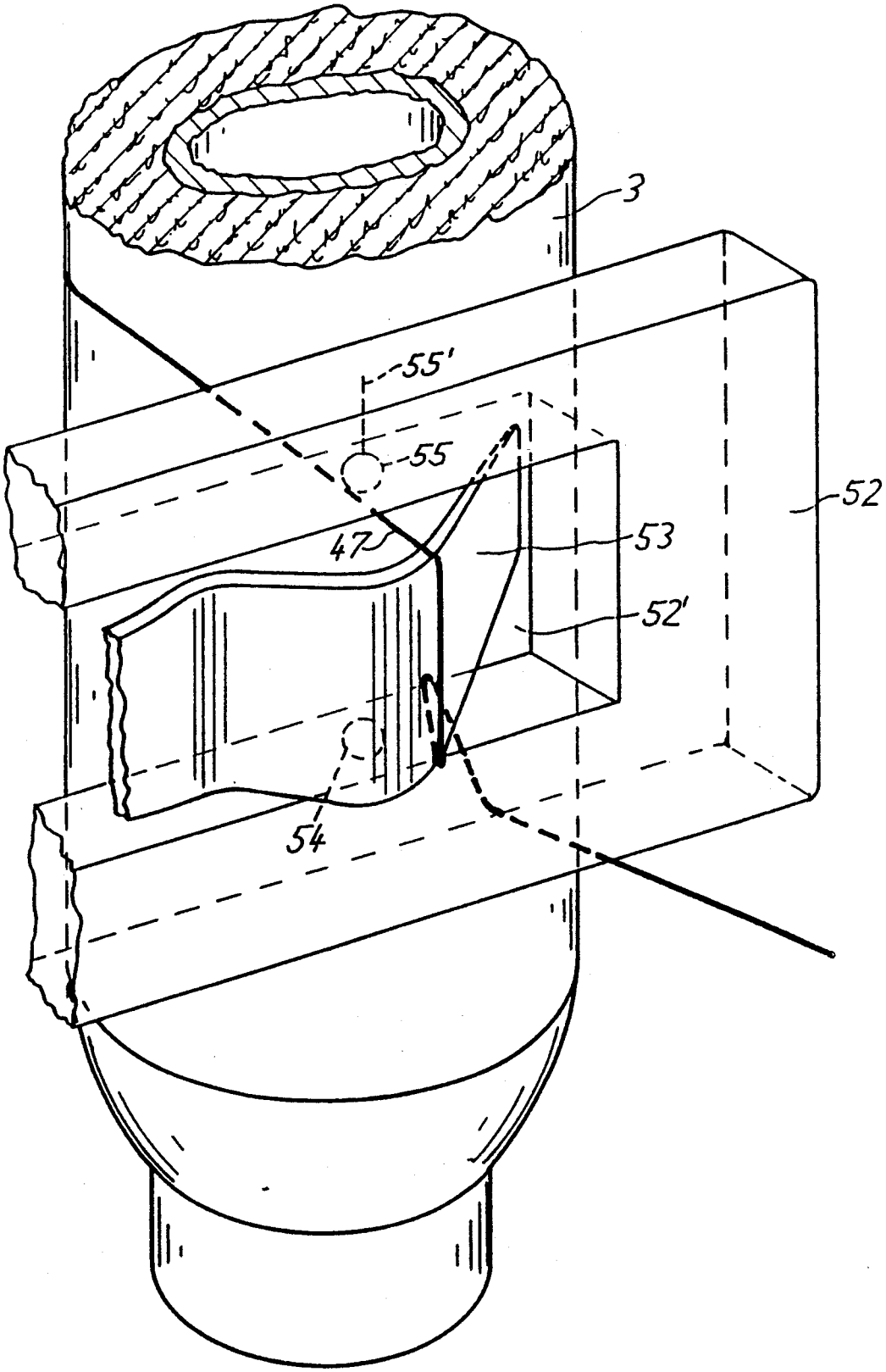
FIG. 3 is an enlarged perspective view similar to FIG. 2 and showing another form variation of the tangential engaging means and the sensing means of the strand end handling apparatus.

In FIG. 3, another variation of the strand end handling apparatus is illustrated which eliminates the need for a separate bracket for supporting the components of the strand sensing device. In this variation, a frame member 52 is pivotally supported on a clamp bracket such as, for example, the clamp bracket 24 and includes a generally planar opening 52'. The frame member 52 has a width extent relatively larger than the width extent of the frame member 15, 17 discussed with respect to the embodiment illustrated in FIGS. 1 and 2. The strand sensing device in this variation includes a light emitting component 54 mounted in the portion of the frame member 52 defining a lower side of the opening 52'. A light beam detecting component 55 is mounted in the portion of the frame member 52 defining an upper side of the opening 52' and is disposed for detecting an interruption of the light beam emitted by the light emitting component 54. The light detecting component 55 is operatively connected via a connector 55' to the control unit 60. In lieu of the blade member 16, 18, a blade member 53 is provided having contoured front and rear surfaces. The front and rear surfaces of the blade member 53 are contoured such that, when the free end of the blade member 53 tangentially engages the outer surface of the yarn package 3, the portions of the front and rear surfaces of the blade member adjacent the light emitting component 54 are disposed outwardly to an extent that the light beam emitted by the light emitting component 54 is intermediate the front surface of the blade member 53 and the outer surface of the yarn package 3. After the strand end 47 of a yarn package 3 has been initially dislodged by the free end of the blade 53, the dislodged strand end moves along the blade member in a direction away from its free end due to the continuing rotation of the yarn package 3 and the dislodged strand end subsequently passes through the light beam emitted by the light emitting component 54. The light detecting component 55 senses the interruption of the light beam by the dislodged strand end 47 and provides a signal via the connector 55' to the control unit 60 for further control thereby of the strand end handling operation.

Figure 4:
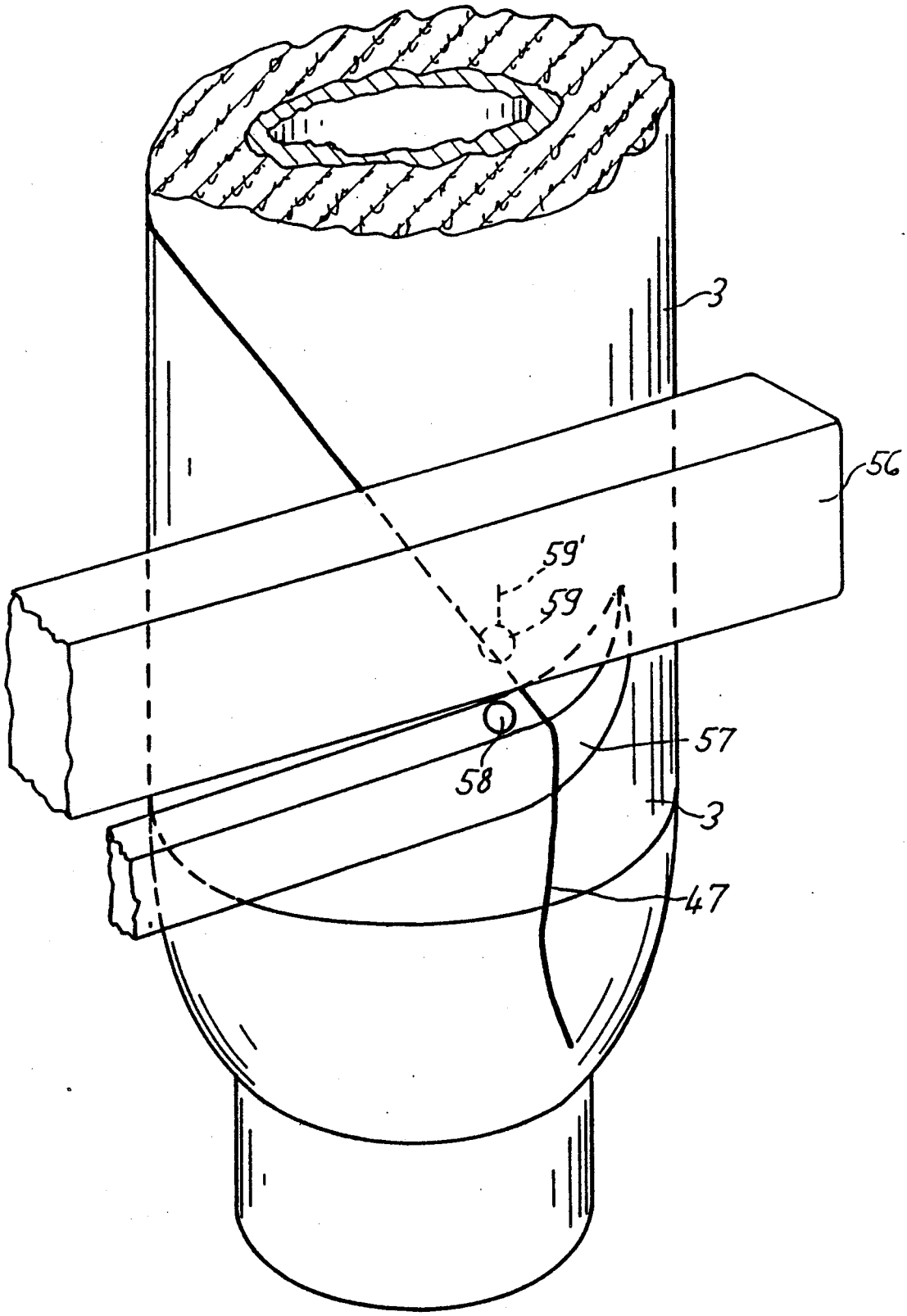
FIG. 4 is an enlarged perspective view similar to FIG. 2 and showing a further form of the tangential engaging means and the sensing means of the strand end handling apparatus.

In FIG. 4, a further variation of the embodiment of the strand end handling apparatus shown in FIG. 1 is illustrated. In this variation, a frame member 56 is provided in lieu of the frame member 15, 17 having one end fixedly connected to a pivot shaft such as, for example, the pivot shaft 22, for pivotal support of the frame member 56 relative to the common pivot shaft 14. In lieu of the blade member 16, 18, a blade member 57 is provided having a curved free end. A light emitting component 58 is mounted in the blade member 57 on a top surface thereof for emitting a generally vertical light beam. A light detecting component 55 is mounted on the frame member 56 on a bottom surface thereof for detecting interruptions of the light beam emitted by the light emitting component 58. The light detecting component 59 is operatively connected via a connector 59' to the control unit 60.

In operation, the blade member 57 tangentially engages the outer surface of the yarn package 3 and dislodges the strand end 47 therefrom. The dislodged strand end 47 moves along the curved free end portion of the blade member 57 and the front surface thereof due to the continuing rotation of the yarn package 3, such that it passes through the light beam emitted by the light emitting component 58. The light detecting component 59 senses the interruption of the light beam emitted by the light emitting component 58 and transmits a signal via the connector 59' to the control unit 60 for responsive controlling by the control unit 60 of the strand end handling operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In an assembly for loosening an end of a strand of textile material built on a tube to form a package, the assembly being of the type having a device for rotation a package about its axis and the assembly being operable to perform a yarn end loosening operation which at least includes the step of dislodging a strand end from the outer surface of a package, a strand end engaging apparatus comprising:

means for substantially tangentially engaging the outer surface of the package during axial rotation thereof to effect dislodgement of a strand end therefrom, said tangential engaging means being movable between an engaged position in which it is positioned for engaging the outer surface of the package and a disengaged position in which it is positioned at a clearance from the outer surface of the package;

means for sensing the dislodgement of a strand end by said tangential engaging means; and control means, operatively connected to said sensing means for controlling the operation of the assembly after the dislodgement of a strand end in response to said sensing including controlling said tangential engaging means to move from its engaged position to its disengaged position.

2. In an assembly for loosening an end of a strand of textile material, the strand end engaging apparatus according to claim 1 and characterized further by search duration means for controlling said tangential engaging means to move from its engaged position to its disengaged position in correspondence with the lapse of a predetermined period of time if said sensing means had not previously sensed a dislodged strand end prior to the lapse of said predetermined period of time.

3. In an assembly for loosening an end of a strand of textile material, the strand end engaging apparatus according to claim 1 and characterized further in that said tangential engaging means includes a blade member having a free end disposable for strand engaging contact with the package and having a front surface facing the package and a rear surface facing away from the package, said surfaces extending from said free end in the direction of unwinding rotation of the package, and said rear surface extending from said free end outwardly from said package for support of a dislodged strand end at a spacing from the package for sensing by said sensing means.

4. In an assembly for loosening an end of a strand of textile material, the strand end engaging apparatus according to claim 3 and characterized further by a guide member extending adjacent said blade member for engagement and guiding of a dislodged strand end intermediate said rear surface and the package at a spacing from said free end.

5. In an assembly for loosening an end of a strand of textile material, the strand end engaging apparatus according to claim 4 and characterized further in that said guide member has an opening extending adjacent the package for extension of said rear surface of said blade member therethrough, said guide member cooperating with said blade member to guide the dislodged strand end through said opening for sensing by said sensing means.

6. In an assembly for loosening end of a strand of textile material, the strand end engaging apparatus according to claim 5 and characterized further in that said opening is defined by opposed surfaces between which said rear surface of said blade member is disposed for guiding of the strand end to extend from one of said opposed surfaces to and across said rear surface and from said rear surface to the other of said opposed surfaces.

7. In an assembly for loosening an end of a strand of textile material, the strand end engaging apparatus according to claim 5 and characterized further in that said blade member is mounted on said guide member and said guide member is pivotally supported for movement of said guide member and said blade member to and away from a package.

8. In an assembly for loosening an end of a strand of textile material, the strand end engaging apparatus according to claim 5 and characterized further in that said sensing means includes a light emitting component for emitting a light beam and a light detecting component, said light emitting component emitting a light beam and said light detecting component detecting an interruption of said light beam by the passage of a dislodged strand end guided by said guide member and said blade member through said light beam.

9. In an assembly for loosening an end of a strand of textile material, the strand end engaging apparatus according to claim 8 and characterized further in that the portion of said front surface of said blade member extends from said free end at a spacing from the package and said light emitting component is disposed to emit said light beam in said spacing.

10. In an assembly for loosening an end of a strand of textile material, the strand end engaging apparatus according to claim and characterized further by means for transporting packages to and from said strand end handling apparatus for the loosening of strand ends on the packages, said control means controlling said transporting means to transport a package from, and a fresh package to, said strand end handling apparatus in response to sensing by said sensing means of a dislodged strand end.

11. In an assembly for loosening an end of a strand of textile material, the strand end engaging apparatus according to claim 1 and characterized further in that said control means includes means for de-activating the package rotating device in response to sensing of a dislodged strand end by said sensing means to thereby effect cessation of the rotation of the package

12. In an assembly for loosening an end of a strand of textile material, the strand end engaging apparatus according to claim 1 and characterized further in that said sensing means includes a light emitting component and a light detecting component, said light emitting component emitting a light beam and said light detecting component detecting an interruption of said light beam by the passage of a dislodged strand end through said light beam.

13. In an assembly for loosening an end of a strand of textile material, the strand end engaging apparatus according to claim 1 and characterized further by end winding suction means for applying suction to the bottom portion of the tube of the package to effect removal of a portion of the strand end remaining thereon following dislodgement of the strand end from the package.

14. In an assembly for loosening an end of a strand of textile material built on a tube to form a package, the assembly being of the type having a device for rotating a package about its axis with a strand end wound with windings progressing away from one end of the tube to the free end of the strand end and the assembly being operable to perform a yarn end loosening operation which at least includes the step of dislodging a strand end from the outer surface of a package, a strand end handling apparatus comprising:

first means for tangentially engaging the outer surface of the package at a first engaging location during axial rotation of the package to effect dislodgement of a strand end therefrom, said first tangential engaging means being movable between an engaged position in which it tangentially engages the outer surface of the package and a disengaged position out of engagement with the package;

second means for tangentially engaging the outer surface of the package at a second engaging location axially intermediate said first engaging location and said tube end during axial rotation of the package to effect dislodgement of a strand end therefrom, said second tangential engaging means being movable between an engaged position in which it tangentially engages the outer surface of the package and a disengaged position out of engagement with the package;

means for sensing the dislodgement of a strand end by at least one of said first and second tangential engaging means; and control means, operatively connected to said sensing means, for controlling at least one of said first and second tangential engaging means to move from its respective engaged position to its respective disengaged position.

15. In an assembly for loosening an end of a strand of textile material, the strand end engaging apparatus according to claim 14 and characterized further in that said control means initially controls said second tangential engaging means to remain in its disengaged position and said first tangential engaging means to move to its engaging position and thereafter controls said second tangential engaging means to move to its engaged position upon the sensing by said sensing means of a strand end dislodged by said first tangential engaging means.

* * * * *